US011514838B2

(12) United States Patent
Feng et al.

(10) Patent No.: US 11,514,838 B2
(45) Date of Patent: Nov. 29, 2022

(54) GATE DRIVING CIRCUIT, DISPLAY DEVICE AND REPAIR METHOD

(71) Applicants: HEFEI BOE JOINT TECHNOLOGY CO., LTD., Anhui (CN); BOE TECHNOLOGY GROUP CO., LTD., Beijing (CN)

(72) Inventors: Xuehuan Feng, Beijing (CN); Yongqian Li, Beijing (CN)

(73) Assignees: HEFEI BOE JOINT TECHNOLOGY CO., LTD., Anhui (CN); BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 17/417,282

(22) PCT Filed: Nov. 4, 2020

(86) PCT No.: PCT/CN2020/126528

§ 371 (c)(1),
(2) Date: Jun. 22, 2021

(87) PCT Pub. No.: WO2021/098515

PCT Pub. Date: May 27, 2021

(65) Prior Publication Data

US 2022/0068190 A1 Mar. 3, 2022

(30) Foreign Application Priority Data

Nov. 18, 2019 (CN) ..... 201911132047.2

(51) Int. Cl.

| | |
|---|---|
| ***G09G 3/3266*** | (2016.01) |
| ***G09G 3/20*** | (2006.01) |
| ***G09G 3/00*** | (2006.01) |

(52) U.S. Cl.
CPC ..... *G09G 3/2092* (2013.01); *G09G 3/006* (2013.01); *G09G 2310/0267* (2013.01); *G09G 2330/04* (2013.01)

(58) Field of Classification Search
CPC ..... G09G 3/2092; G09G 3/006; G09G 2310/0267; G09G 2330/04; G09G 3/3266;

(Continued)

(56) References Cited

U.S. PATENT DOCUMENTS 4,820,222 A * 4/1989 Holmberg ..... G02F 1/1309 438/30
5,555,001 A * 9/1996 Lee ..... G09G 3/3688 345/103

(Continued)

FOREIGN PATENT DOCUMENTS

CN 1877399 12/2006
CN 101399272 4/2009

(Continued)

OTHER PUBLICATIONS

International Search Report from PCT/CN2020/126528 dated Jan. 27, 2021.

(Continued)

*Primary Examiner* — Jose R Soto Lopez
(74) *Attorney, Agent, or Firm* — Calfee, Halter & Griswold LLP

(57) ABSTRACT

The present disclosure relates to a gate drive circuit. The gate drive circuit includes: cascaded GOA units, first clock signal lines, second clock signal lines, connecting lines and electrostatic protection sub-circuits. The first clock signal lines are used to provide various clock signals to the GOA units. The second clock signal lines are used to, when any of the clock signal lines is broken, replace the broken clock (Continued)

signal line to transmit a corresponding clock signal. The electrostatic protection sub-circuits are electrically connected to corresponding first clock signal lines or corresponding second clock signal lines through the connecting lines. Orthographic projections of the connecting lines on a plane where corresponding first clock signal lines or corresponding second clock signal lines are located intersect with the corresponding first clock signal lines and the corresponding second clock signal lines, respectively.

18 Claims, 11 Drawing Sheets

(58) Field of Classification Search
CPC ... G09G 2300/0426; G09G 2310/0286; G09G 2330/08; G09G 3/20
See application file for complete search history.

(56) References Cited

U.S. PATENT DOCUMENTS 5,619,223 A * 4/1997 Lee ..... G09G 3/3677 345/100
6,333,661 B1 * 12/2001 Ando ..... G09G 3/3688 327/318
6,465,768 B1 * 10/2002 Ker ..... H01L 27/0277 250/214.1
6,625,666 B1 * 9/2003 Kim ..... G09G 5/006 345/11
7,538,848 B2 5/2009 Park et al.
7,834,360 B2 11/2010 Choi et al.
8,031,317 B2 10/2011 Park et al.
8,686,980 B2 4/2014 Yoshida et al.
10,997,899 B1 * 5/2021 Bae ..... G09G 3/2092
2005/0012873 A1 1/2005 Park et al.
2005/0276369 A1 * 12/2005 Mutaguchi ..... G09G 3/3648 377/64
2006/0289939 A1 * 12/2006 Kim ..... G02F 1/136204 257/368
2008/0043006 A1 2/2008 Wei et al.
2009/0085034 A1 * 4/2009 Choi ..... H01L 27/124 257/59
2009/0251449 A1 10/2009 Park et al.
2010/0001941 A1 * 1/2010 Shin ..... G09G 3/3677 345/98
2010/0238094 A1 * 9/2010 Cho ..... G09G 3/3208 345/82
2013/0162613 A1 * 6/2013 Watanabe ..... G09G 3/3688 345/208
2013/0307421 A1 * 11/2013 Tanada ..... G09G 3/3659 315/172
2013/0321644 A1 * 12/2013 Chung ..... G09G 3/006 348/184
2014/0055440 A1 * 2/2014 Cho ..... G09G 3/36 345/212
2014/0167769 A1 * 6/2014 Kim ..... G09G 3/3208 324/414
2014/0210807 A1 * 7/2014 Kim ..... H01L 27/3265 345/212
2017/0139292 A1 * 5/2017 Yu ..... G09G 3/3648
2018/0211582 A1 * 7/2018 Sakariya ..... G09G 3/2088
2018/0211612 A1 * 7/2018 Hong ..... G02F 1/13306
2018/0301103 A1 * 10/2018 Li ..... G02F 1/136259
2019/0347985 A1 * 11/2019 Shaeffer ..... G09G 3/3216
2020/0168285 A1 * 5/2020 Chen ..... G11C 19/28
2020/0174328 A1 * 6/2020 He ..... G02F 1/136259
2020/0194425 A1 * 6/2020 Long ..... H01L 29/786
2020/0211466 A1 * 7/2020 In ..... G09G 3/2096
2020/0410913 A1 * 12/2020 Wu ..... G09G 3/006
2021/0082963 A1 * 3/2021 Long ..... G09G 3/20
2021/0256898 A1 * 8/2021 Kim ..... G09G 3/2014
2021/0398479 A1 * 12/2021 Kim ..... G09G 3/32

FOREIGN PATENT DOCUMENTS

CN 101655613 2/2010
CN 101655613 2/2012
CN 103197479 7/2013
CN 104409065 3/2015
CN 104900206 9/2015
CN 103197479 11/2015
CN 106803414 6/2017
CN 107340659 11/2017
CN 108877683 11/2018
CN 110767149 2/2020
KR 20050102704 10/2005
KR 20110052986 5/2011
WO 2014146372 9/2014

OTHER PUBLICATIONS

Written Opinion from PCT/CN2020/126528 dated Jan. 27, 2021.
Office action from Chinese Application No. 201911132047.2 dated Feb. 3, 2021.

* cited by examiner

GATE DRIVING CIRCUIT, DISPLAY DEVICE AND REPAIR METHOD

This application is the U.S. national stage entry of PCT/CN2020/126528, filed on Nov. 4, 2020, which claims priority to Chinese Patent Application No. 201911132047.2, filed Nov. 18, 2019, the entire contents of which are incorporated herein by reference.

TECHNICAL FIELD

The present disclosure relates to the circuit repair technical field, and in particular, to a gate drive circuit, a display device and a repair method.

BACKGROUND

Most of the existing flat panel display devices use a gate drive circuit (Gate Driver On Array, GOA) technology, in which multiple cascaded shift registers constitute the gate drive circuit. This GOA technology is a technology which integrates the gate drive circuit of a display device on an array substrate. The use of the GOA technology can reduce the amount of ICs (Integrated Circuits) used, thereby reducing the manufacturing cost of the display device.

As the resolution of display devices increases, the density of gate drive circuits in display devices is increasingly high, and the widths of clock signal lines used for the gate drive circuits are getting narrower, making the clock signal lines prone to breakage.

SUMMARY

An objective of embodiments of the present disclosure is to provide a gate drive circuit, a display device and a repair method, so as to repair broken clock signal lines of a gate drive circuit.

According to a first aspect, there is provided a gate drive circuit which adopts a multilayer circuit board structure and includes: a plurality of cascaded GOA units, a plurality of first clock signal lines, a plurality of second clock signal lines, connecting lines and a plurality of electrostatic protection sub-circuits;

wherein:

the plurality of first clock signal lines are electrically connected to the GOA units, and used to provide various clock signals to the GOA units;

the plurality of second clock signal lines are electrically connected to the GOA units, and are used to, when any of the clock signal lines is broken, replace the broken clock signal line to transmit a corresponding clock signal;

the plurality of electrostatic protection sub-circuits are electrically connected to corresponding first clock signal lines or corresponding second clock signal lines through the connecting lines, so as to prevent the first clock signal lines or the second clock signal lines from being damaged by static electricity; and the connecting lines are arranged on a layer in the multilayer circuit board structure which is different from layers where the first clock signal lines and the second clock signal lines are arranged in the multilayer circuit board structure, and orthographic projections of the connecting lines on a plane where corresponding first clock signal lines or corresponding second clock signal lines are located intersect with the corresponding first clock signal lines and the corresponding second clock signal lines, respectively.

According to an exemplary embodiment, the plurality of first clock signal lines and the plurality of second clock signal lines are arranged on a same layer in the circuit board and arranged side by side.

According to an exemplary embodiment, the plurality of first clock signal lines are electrically connected to the GOA units, the plurality of second clock signal lines are electrically connected to the GOA units, and the plurality of first clock signal lines are located on sides of the plurality of second clock signal lines away from the GOA units.

According to an exemplary embodiment, the second clock signal lines and the first clock signal lines are arranged in a one-to-one correspondence.

According to an exemplary embodiment, the connecting lines include a plurality of first connecting lines and a plurality of second connecting lines, and each of the first clock signal lines is connected to one of the first connecting lines; and each of the second clock signal lines is connected to one of the second connecting lines.

According to an exemplary embodiment, the plurality of first clock signal lines include a first clock signal line to be repaired, and the first clock signal line to be repaired is electrically connected to a second clock signal line corresponding to the first clock signal line to be repaired through one of the first connecting lines; and/or the plurality of second clock signal lines include a second clock signal line to be repaired, and the second clock signal line to be repaired is electrically connected to a first clock signal line corresponding to the second clock signal line to be repaired through one of the second connecting lines.

According to an exemplary embodiment, only one of the first connecting line connected to the first clock signal line to be repaired and a second connecting line connected to the second clock signal line corresponding to the first clock signal line to be repaired is set to be electrically connected to a corresponding electrostatic protection sub-circuit, and the other connecting line is set to be disconnected from a corresponding electrostatic protection sub-circuit; and/or, only one of the second connecting line connected to the second clock signal line to be repaired and a first connecting line connected to the first clock signal line corresponding to the second clock signal line to be repaired is set to be electrically connected to a corresponding electrostatic protection sub-circuit, and the other connecting line is set to be disconnected from a corresponding electrostatic protection sub-circuit.

According to an exemplary embodiment, the first connecting line connected to the first clock signal line to be repaired is set to be connected to the corresponding electrostatic protection sub-circuit, and the second connecting line connected to the second clock signal line corresponding to the first clock signal line to be repaired is set to be disconnected from a corresponding electrostatic protection sub-circuit.

According to an exemplary embodiment, the second connecting line connected to the second clock signal line to be repaired is set to be connected to the corresponding electrostatic protection sub-circuit, and the first connecting line connected to the first clock signal line corresponding to the second clock signal line to be repaired is set to be disconnected from a corresponding electrostatic protection sub-circuit.

According to an exemplary embodiment, a number of the plurality of second clock signal lines is twice that of the plurality of first clock signal lines, and one of the first clock signal lines corresponds to two of the second clock signal lines.

According to an exemplary embodiment, the plurality of first clock signal lines include a first clock signal line to be repaired, and the first clock signal line to be repaired is electrically connected to two second clock signal lines corresponding to the first clock signal line to be repaired through the first connecting lines.

According to another aspect, there is provided a display device including the gate drive circuit as described above, and further including a clock signal generator and a clock signal interface, wherein the clock signal interface is connected with the clock signal generator, and the clock signal interface is provided on a circuit board where the gate drive circuit is located;

wherein the clock signal generator is used to provide corresponding clock signals to the first clock signal line and the second clock signal line in the gate drive circuit; and wherein the clock signal interface is used to input the clock signals from the clock signal generator to the gate drive circuit.

According to another aspect, there is provided a repair method for the gate drive circuit described above, including:

determining a first clock signal line to be repaired which is broken;

connecting the first clock signal line to be repaired to one of second clock signal lines through connecting lines, wherein the connecting lines include a first connecting line connected to the first clock signal line to be repaired and a second connecting line connected to the one of second clock signal lines; and/or determining a second clock signal line to be repaired, wherein the second clock signal line to be repaired is electrically connected to one of first clock signal lines corresponding to the second clock signal line to be repaired through the second connecting line;

keeping only one of the following connecting lines being connected to a corresponding electrostatic protection sub-circuit: the first connecting line connected to the first clock signal line to be repaired; and the second connecting line connected to the second clock signal line corresponding to the first clock signal line to be repaired, and disconnecting the other connecting line from a corresponding electrostatic protection sub-circuit;

and/or keeping only one of the following connecting lines being connected to a corresponding electrostatic protection sub-circuit: the second connecting line connected to the second clock signal line to be repaired; and the first connecting line connected to the first clock signal line corresponding to the second clock signal line to be repaired, and disconnecting the other connecting lines from a corresponding electrostatic protection sub-circuit.

According to an exemplary embodiment, connecting the first clock signal line to be repaired to one of second clock signal lines through connecting lines, includes:

obtaining an intersection point between an orthographic projection of the first connecting line connected to the first clock signal line to be repaired on a plane wherein the second clock signal line corresponding to the first clock signal line to be repaired is located and the second clock signal line, and connecting the first connecting line and the second clock signal line based on the intersection point; or obtaining an intersection point between an orthographic projection of the second connecting line connected to the second clock signal line on a plane wherein the first clock signal line to be repaired corresponding to the second clock signal line is located and the first clock signal line to repaired, and connecting the second connecting line and the first clock signal line to be repaired based on the interaction point.

According to an exemplary embodiment, connecting the first connecting line and the second clock signal line based on the intersection point include:

punching a through hole at the intersection point, to make the through hole formed between a circuit board layer where the first connecting line is located and a circuit board layer where the second clock signal line is located, and filing the through hole with tungsten powder to realize connection between the first connecting line and the second clock signal line; or wherein connecting the second connecting line and the first clock signal line to be repaired based on the intersection point includes:

punching a through hole at the intersection point, to make the through hole formed between a circuit board layer where the second connecting line is located and a circuit board layer where the clock signal line to be repaired is located, and filing the through hole with tungsten powder to realize connection between the second connecting line and the first clock signal line to be repaired.

According to technical solutions according to embodiments of the present disclosure, the second clock signal lines parallel to the clock signal lines are provided in the gate drive circuit, and a broken clock signal line can be repaired by a connecting line for electrostatic protection. Thus, the technical solutions can solve the breakage problem of the clock signal lines in the gate drive circuit.

BRIEF DESCRIPTION OF THE DRAWINGS

Other features, purposes and advantages of the present disclosure will become more apparent from detailed descriptions of exemplary embodiments with reference to the following drawings.

DETAILED DESCRIPTION

Figure 1:
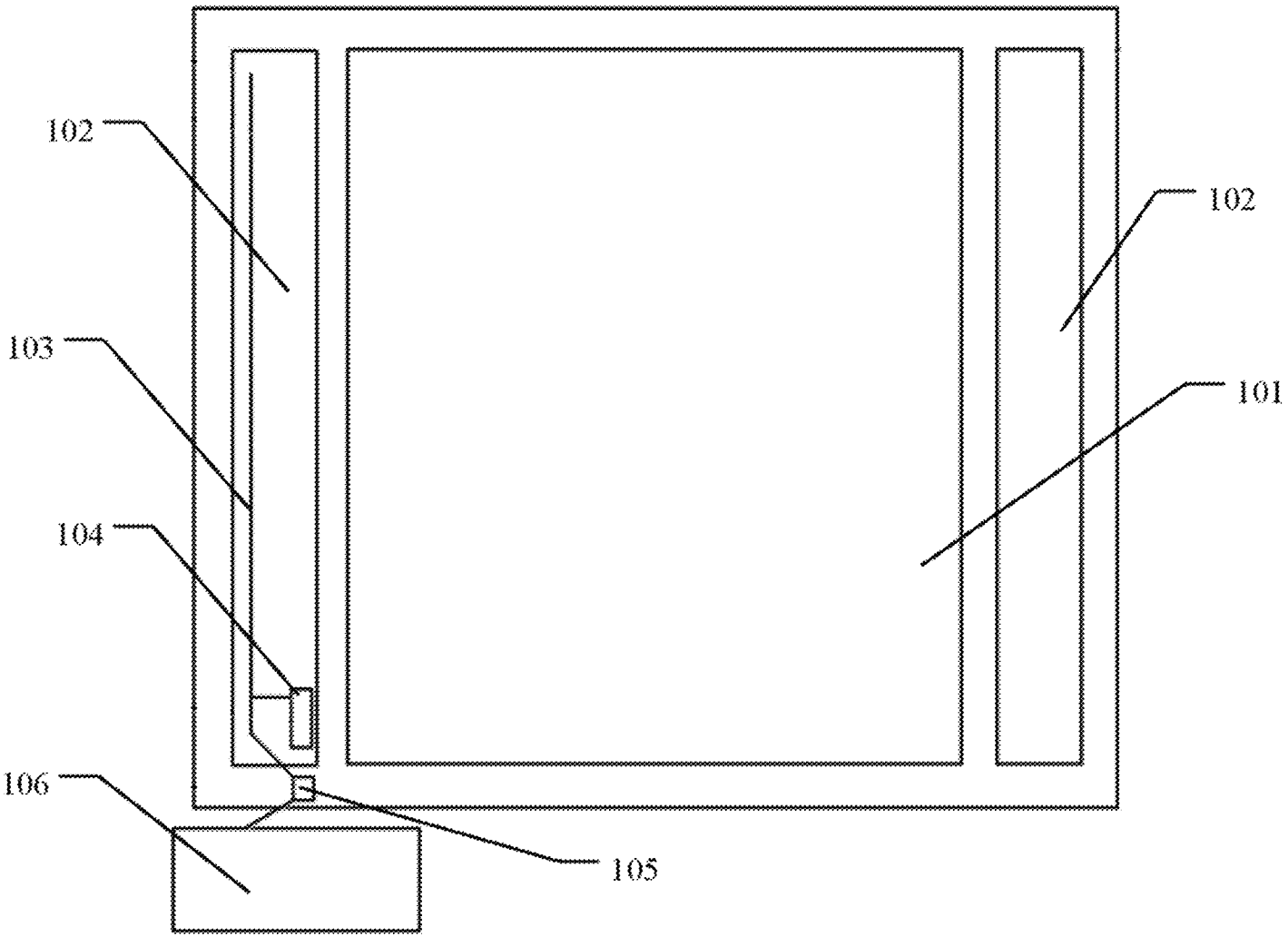
FIG. 1 shows an exemplary structural block diagram of a display drive circuit according to an embodiment of the present disclosure.

The present disclosure will be further described in detail below with reference to drawings and embodiments. It can be understood that the exemplary embodiments described here are only used to explain the present disclosure, but should not be construed as constituting any limitations on the present disclosure. In addition, it should be noted that, for ease of description, only related parts are shown in the drawings.

Unless otherwise defined, the technical terms or scientific terms used in the present disclosure shall have the usual meanings understood by those with ordinary skills in this art. The "first", "second" and similar words used in the present disclosure do not indicate any order, quantity or importance, but are only used to distinguish different components. The words "include" or "comprise" and other similar words used in the present disclosure mean that an element or item appearing before the word covers an element or item listed after the word and their equivalents, but does not exclude other elements or items. Words such as "connected" or "in connection" used in the present disclosure are not limited to physical or mechanical connections, but may include electrical connections, whether direct or indirect. The words "up", "down", "left", "right", and so on used in the present disclosure are only used to indicate the relative position relationship. When the absolute position of a described object changes, the relative position relationship may also change accordingly.

It should be noted that embodiments in the present disclosure and features in the embodiments can be combined with each other if such combination will not result in conflict. Hereinafter, the present disclosure will be described in detail with reference to the drawings and embodiments.

FIG. 1 shows an exemplary structure diagram of a display drive circuit. As shown in FIG. 1, the display drive circuit includes a gate drive circuit 102, a clock signal generator 106, and a clock signal interface 105. The clock signal interface 105 is provided on a circuit board where the gate drive circuit 102 is located. The clock signal generator 106 is used for providing corresponding clock signals to clock signal lines 103 of the gate drive circuit 102. The clock signal interface 105 is used to input the clock signals of the clock signal generator 106 to the gate drive circuit 102. The gate drive circuit further includes electrostatic protection sub-circuits 104, which are connected to the clock signal lines and used to prevent the clock signal lines and second clock signal lines from being damaged by static electricity.

The structure of the gate drive circuit and the structure of the clock signal lines will be further described below in conjunction with FIGS. 2 to 7.

Figure 2:
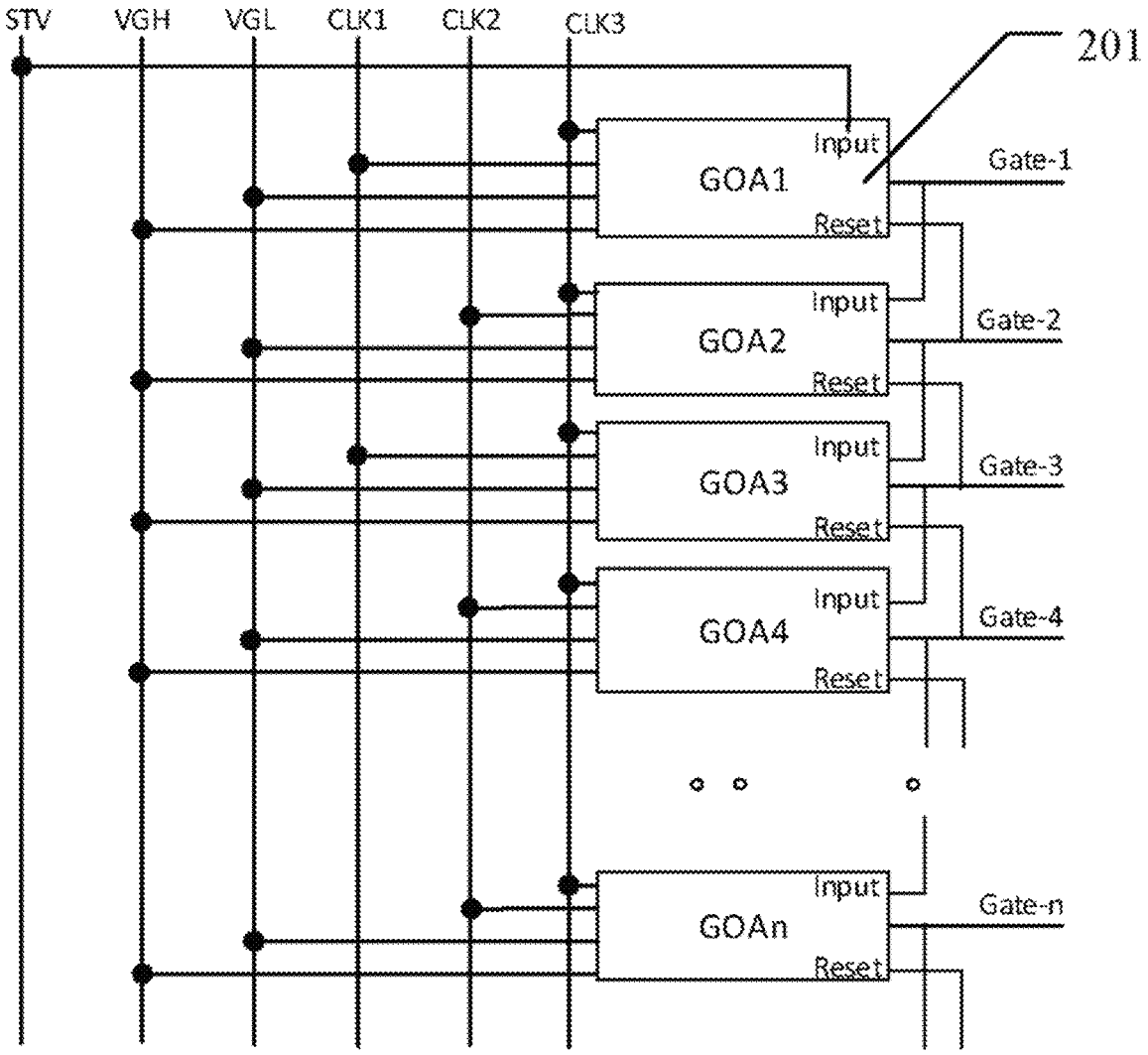
FIG. 2 shows an exemplary structural block diagram of a gate drive circuit according to an embodiment of the present disclosure.
Figure 3:
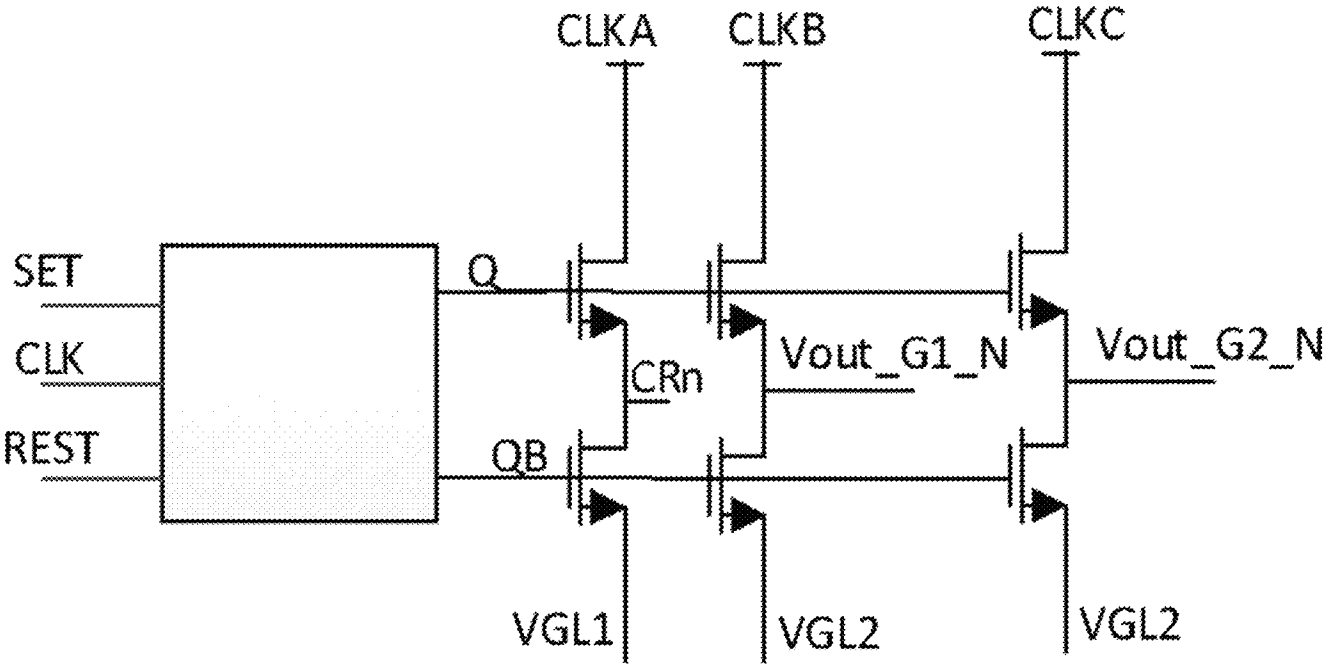
FIG. 3 shows a schematic framework diagram showing principles of an external compensation gate drive circuit according to an embodiment of the present disclosure.

As shown in FIG. 2, a gate drive circuit includes multiple cascaded GOA units 201. Each GOA unit is connected to multiple clock signal lines. As shown in the figure, each GOA unit is connected to clock signal lines CLK1, CLK2, and CLK3. In actual applications, the number of clock signal lines used by different GOA circuits may be different, and embodiments of the present disclosure do not impose specific limitations on this. FIG. 3 shows a schematic frame diagram showing principles of an external compensation GOA. Each GOA unit needs three groups of CLKs (CLKA, CLKB, CLKC) to realize the output of each gate and the output of the cascade relationship. In order to reduce the CLK load in display products, each group of CLKs needs about ten clock signal lines, and thus a total of 30 groups of CLK channels are required. Further, low-voltage signal lines such as SET, RESET, VGH, VGL and so on are needed. Accordingly, 35 to 40 groups of signal lines are required. There are so many signal lines, and it is hard for existing devices to meet such requirements. Moreover, the large number of signal test pads will occupy a large peripheral layout space, which is not conducive to improving the utilization rate of the glass substrate.

Figure 4:
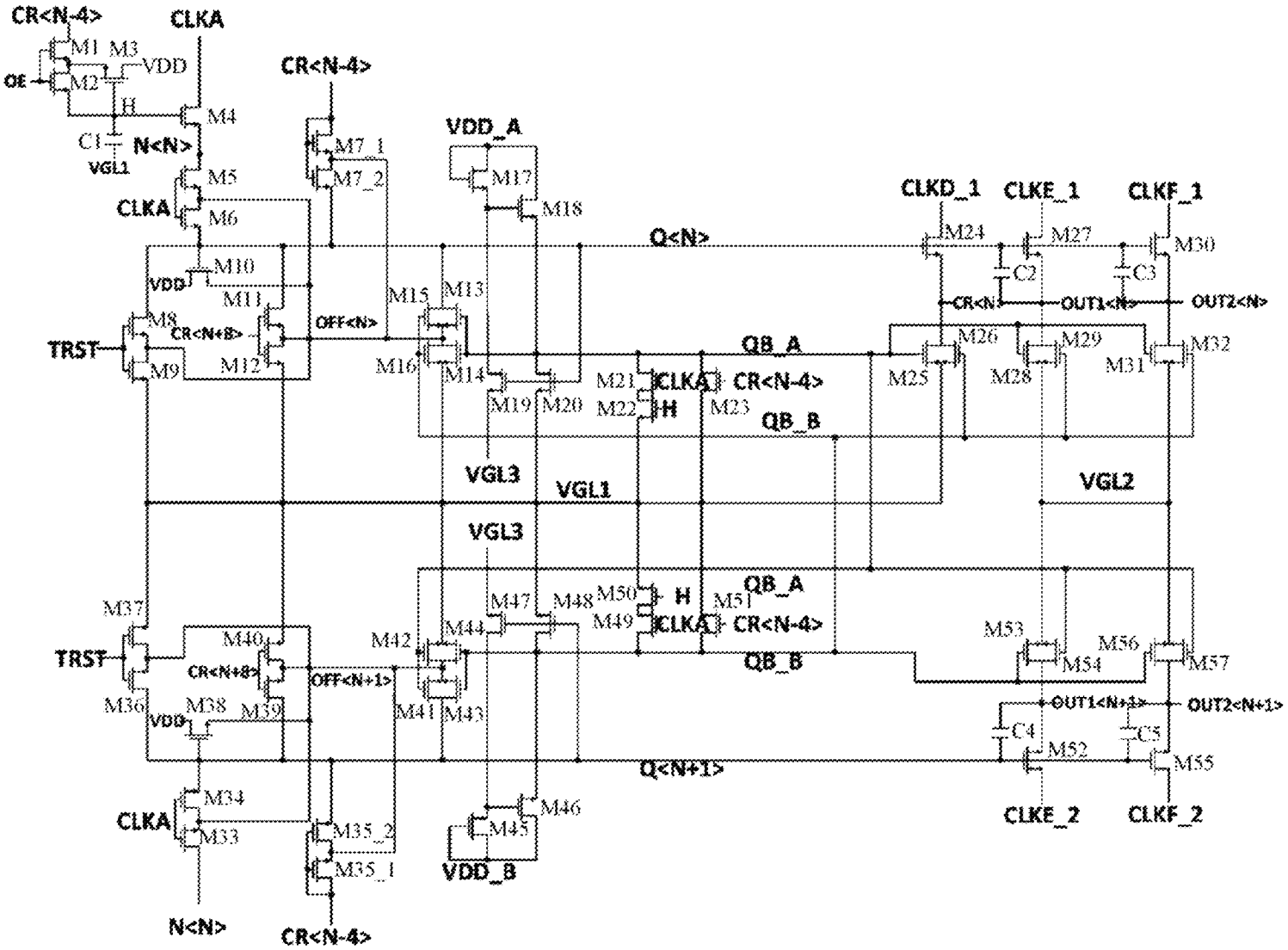
FIG. 4 shows a circuit diagram of a gate drive circuit according to an embodiment of the present disclosure.

FIG. 4 shows a specific circuit diagram of a gate drive circuit. As shown in FIG. 4, the gate drive circuit includes a clock signal line CLKD_1, a clock signal line CLKE_1, and a clock signal line CLKF_1 to receive the clock signals from a shift register. The main function of the CLKD signal line is cascade connection. The main function of CLKE is used for output. The use of multiple clock signal lines can make the waveforms of the driving signals output by the gate drive circuit overlap, and can increase the pre-charging time of each row of sub-pixel units, and accordingly, the gate drive circuit can be applicable for high-frequency scanning display.

Figure 5:
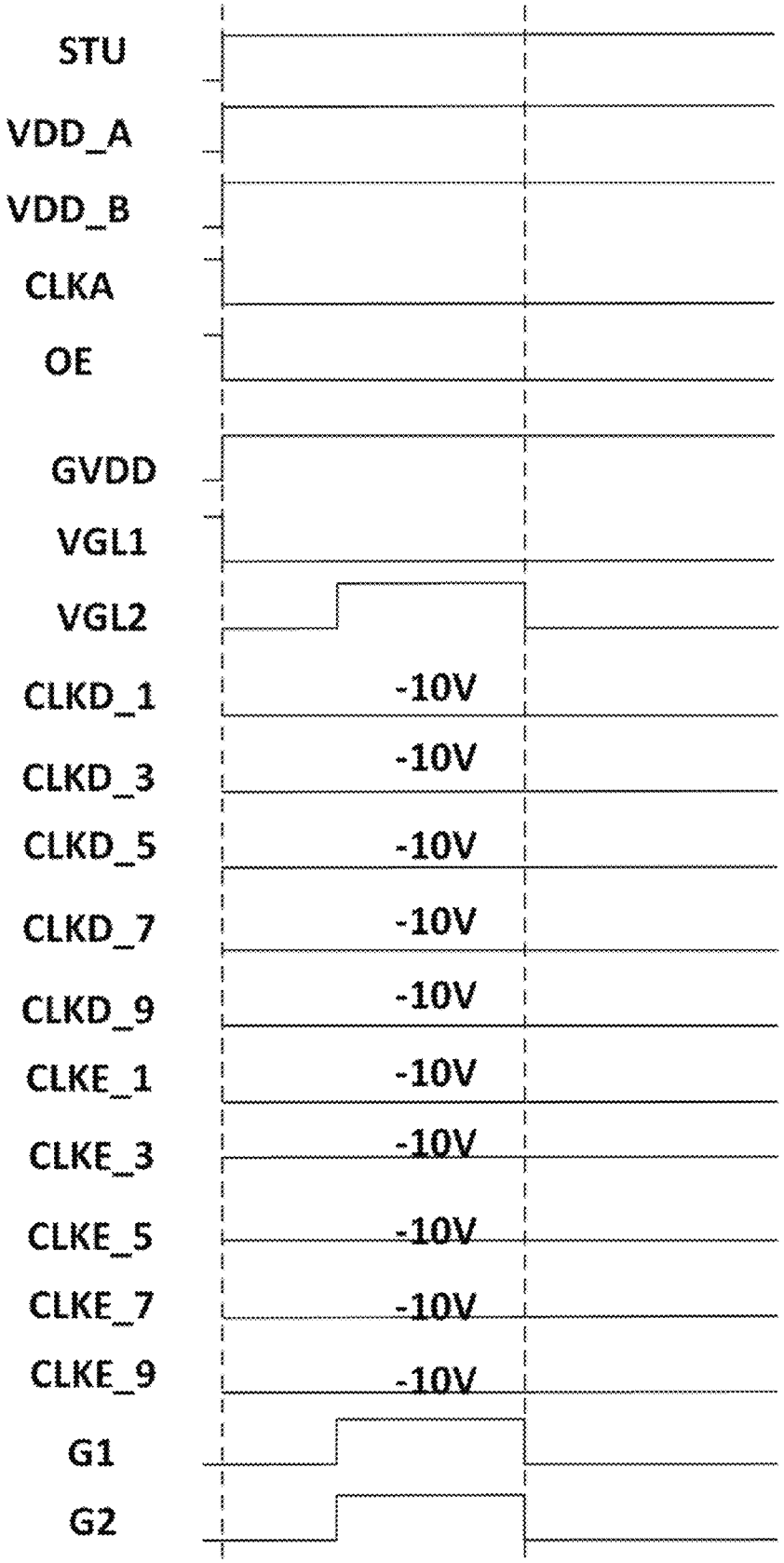
FIG. 5 shows a Bypass waveform diagram of an array test (AT) according to an embodiment of the present disclosure.
Figure 6:
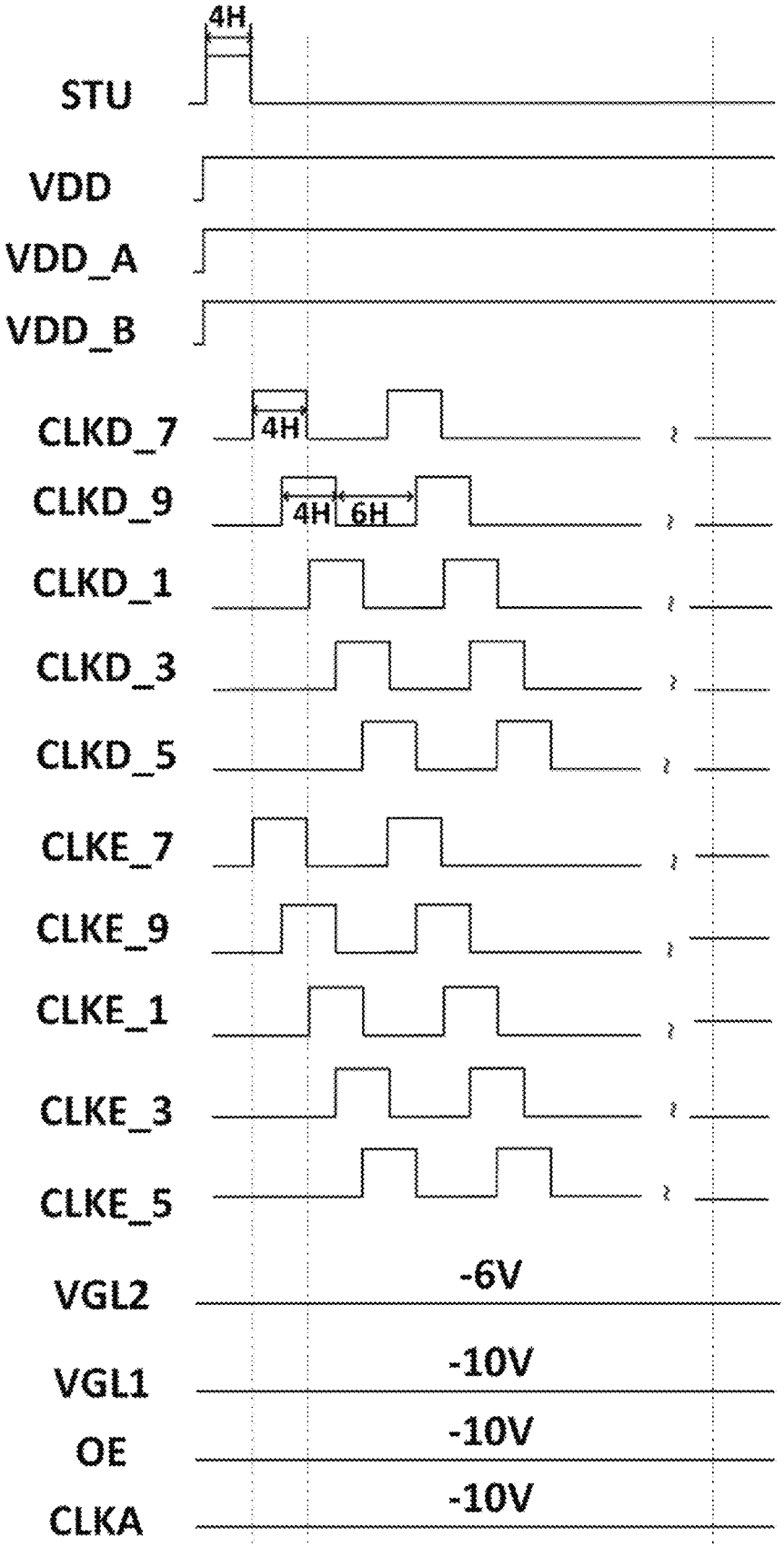
FIG. 6 shows a full gate waveform diagram of an array test (AT) according to an embodiment of the present disclosure.

FIG. 5 shows a Bypass waveform diagram of an array test (AT) according to an embodiment of the present disclosure. FIG. 6 shows a Full Gate waveform diagram of an array test (AT) according to an embodiment of the present disclosure. FIG. 5 and FIG. 6 are the driving timing diagrams of the gate drive circuit in FIG. 4. The AT time sequence waveform diagram of the clock signal line CLKE is the same as the AT time sequence waveform diagram of the clock signal line CLKD, and thus the clock signal line CLKE and the clock signal line CLKD can be short-connected, and the clock signal line CLKF and the clock signal line CLKD can also be short-connected.

As the frame of display devices become narrow and the resolution becomes high, the space left for the gate drive circuit is becoming more and more limited, and the line widths of the digital signal lines are becoming narrower and narrower. In addition, the traces of the entire clock signal lines are long, from the clock signal generator 106 to the GOA units via the clock signal interface and the electrostatic protection sub-circuits. Therefore, it is easy for breakage to occur in the clock signal lines, especially in the pads of Cell Test (CT) and Array Test (AT), because the lines are narrow.

Cell Test (CT for short) refers to testing the OLED panel to check whether there are dad pixels on the OLED backplane. ET refers to the Electrical Test. The ET pins are displayed on the backplane. The ET pins are connected to CT pads. Various signals are provided by the ET pins during the CT test phase, such as gate signals and data signals during the test phase. Array Test (AT) is used to, after the backplane is produced, determine whether there is a breakage or short circuit by pricking test resistors.

As the frame of display devices becomes narrow, the space left for the GOA circuits is very limited. Therefore, in the AT and CT wirings, the line widths of many CLK lines are relatively narrow, and thus it is easy for these lines to break.

Figure 7:
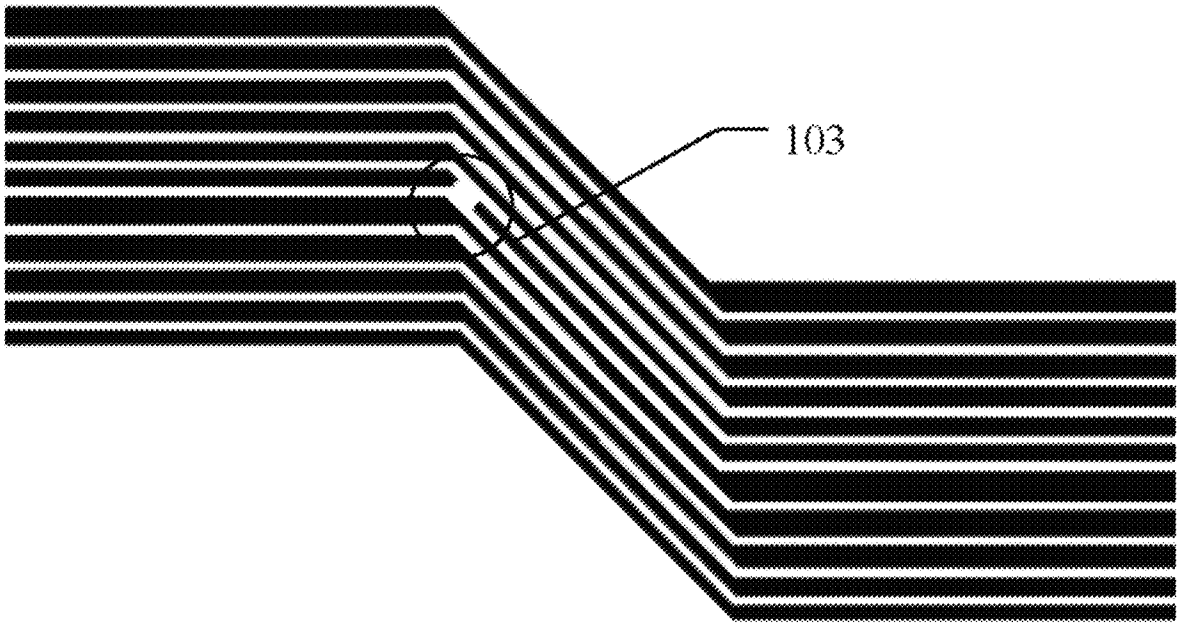
FIG. 7 is a schematic diagram showing a part where breakage of a clock signal line occurs between a clock signal interface and an electrostatic protection sub-circuit according to an embodiment of the present disclosure.

FIG. 7 is a schematic diagram showing a part where breakage clock signal lines between a clock signal interface and an electrostatic protection sub-circuit. The narrow clock signal lines 103 are prone to breakage during the process of preparing the circuit board, especially at the positions where the lines need to be formed as polygonal lines. Consequently, the gate drive circuit cannot work normally.

In order to repair a broken clock signal line, the present disclosure provides the following gate drive circuit. Description will be given below in conjunction with FIG. 1, FIG. 2 and FIG. 7. The gate drive circuit adopts a multilayer circuit board structure, including: a plurality of GOA units 201 which are cascaded, a plurality of first clock signal lines 103, a plurality of second clock signal lines 103', connecting lines 305, and a plurality of electrostatic protection sub-circuits 301.

The plurality of first clock signal lines 103 are electrically connected to the GOA units, and used to provide various clock signals to the GOA units.

The plurality of second clock signal lines 103' are electrically connected to the GOA units, and are used to, when any of the clock signal lines is broken, replace the broken clock signal line to transmit a corresponding clock signal.

The plurality of electrostatic protection sub-circuits 301 are electrically connected to corresponding first clock signal lines or corresponding second clock signal lines through the connecting lines 305, so as to prevent the first clock signal lines or the second clock signal lines from being damaged by static electricity.

The connecting lines 305 are arranged on a layer in the multilayer circuit board structure which is different from layers where the first clock signal lines 103 and the second clock signal lines 103' are arranged in the multilayer circuit board structure, and orthographic projections of the connecting lines 305 on a plane where corresponding clock signal lines or corresponding second clock signal lines are located intersect with the corresponding first clock signal lines 103 and the corresponding second clock signal lines 103', respectively.

The plurality of first clock signal lines 103 and the plurality of second clock signal lines 103' may be arranged on a same layer. Alternatively, the plurality of first clock signal lines 103 and the plurality of second clock signal lines 103' may be arranged on different layers.

According to an exemplary embodiment, the plurality of first clock signal lines 103 and the plurality of second clock signal lines 103' are arranged on a same layer in the circuit board, and are arranged side by side. The connecting lines 305 are arranged side by side.

The plurality of first clock signal lines 103 are electrically connected to the GOA units, the plurality of second clock signal lines 103' are electrically connected to the GOA units, and the plurality of first clock signal lines 103 are located on sides of the plurality of second clock signal lines 103' away from the GOA units.

Figure 8:
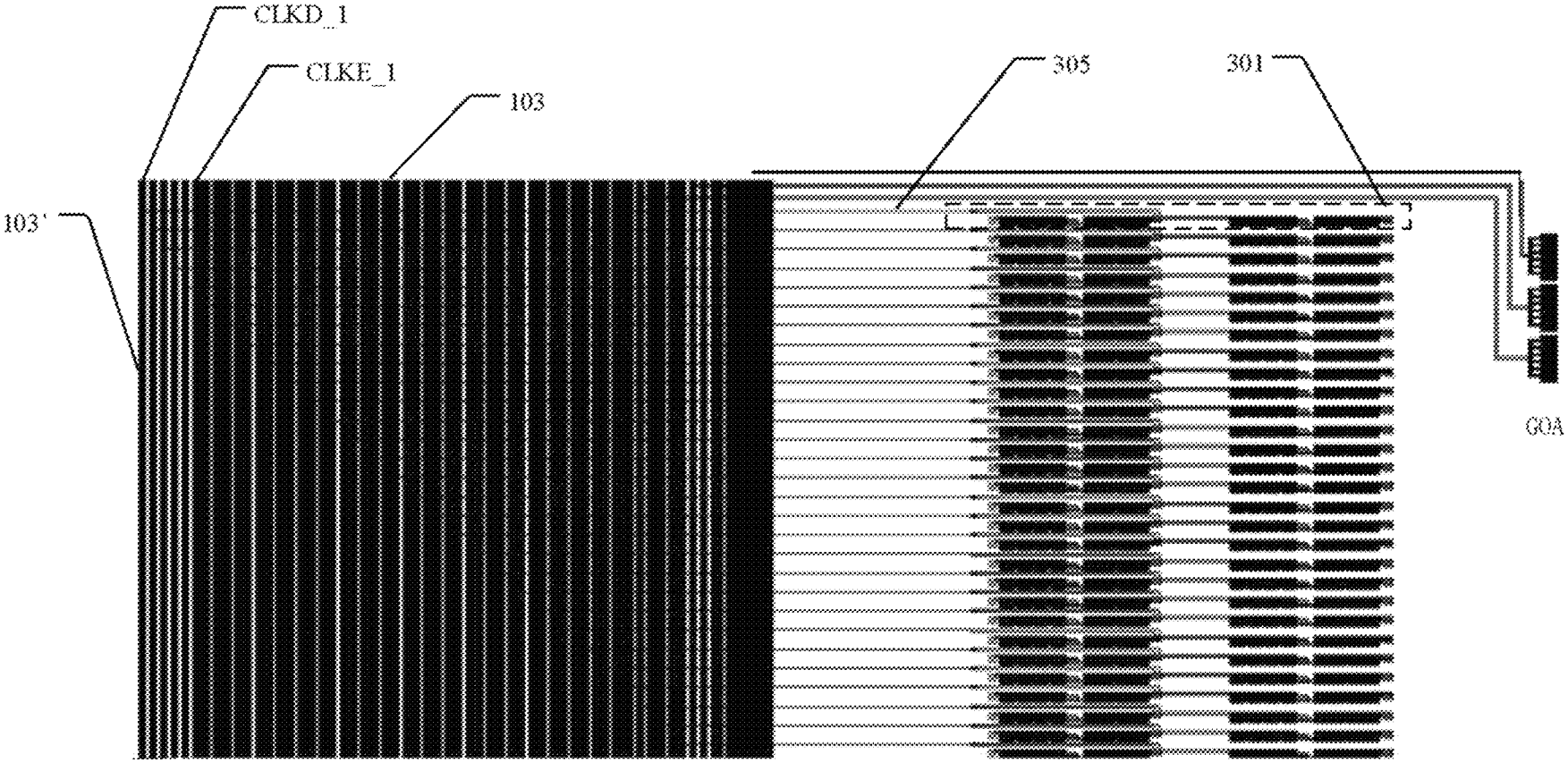
FIG. 8 shows an exemplary wiring diagram of a gate drive circuit according to an embodiment of the present disclosure.

FIG. 8 is a schematic diagram of a part of lines of the gate drive circuit. As shown in the figure, the clock signal lines 103 and the second clock signal lines 103' are arranged side by side vertically, and each first clock signal line 103 and each second clock signal line 103' are connected to a corresponding electrostatic protection 301 via corresponding connecting lines 305. The connecting lines 305 are arranged side by side horizontally. In an exemplary embodiment, the second clock signal lines and the first clock signal lines are arranged in a one-to-one correspondence. For example, for the gate drive circuit with three clock signal lines as shown in FIG. 2, three corresponding second clock signal lines can be provided. When one of the first clock signal lines is broken, the broken first clock signal line can be repaired by a corresponding second clock signal line.

Or, the plurality of second clock signal lines include a second clock signal line to be repaired, and the second clock signal line to be repaired is electrically connected to a first clock signal line corresponding to the second clock signal line to be repaired by a second connecting line.

It should be noted that the one-to-one correspondence between the second clock signal lines and the first clock signal lines is only an exemplary implementation. In practical applications, one first clock signal line may correspond to multiple corresponding second clock signal lines, or multiple first clock signal lines may correspond to one corresponding second clock signal line. The former arrangement is conducive to improving the success rate of repair, and the latter arrangement is conducive to cost saving.

Figure 9:
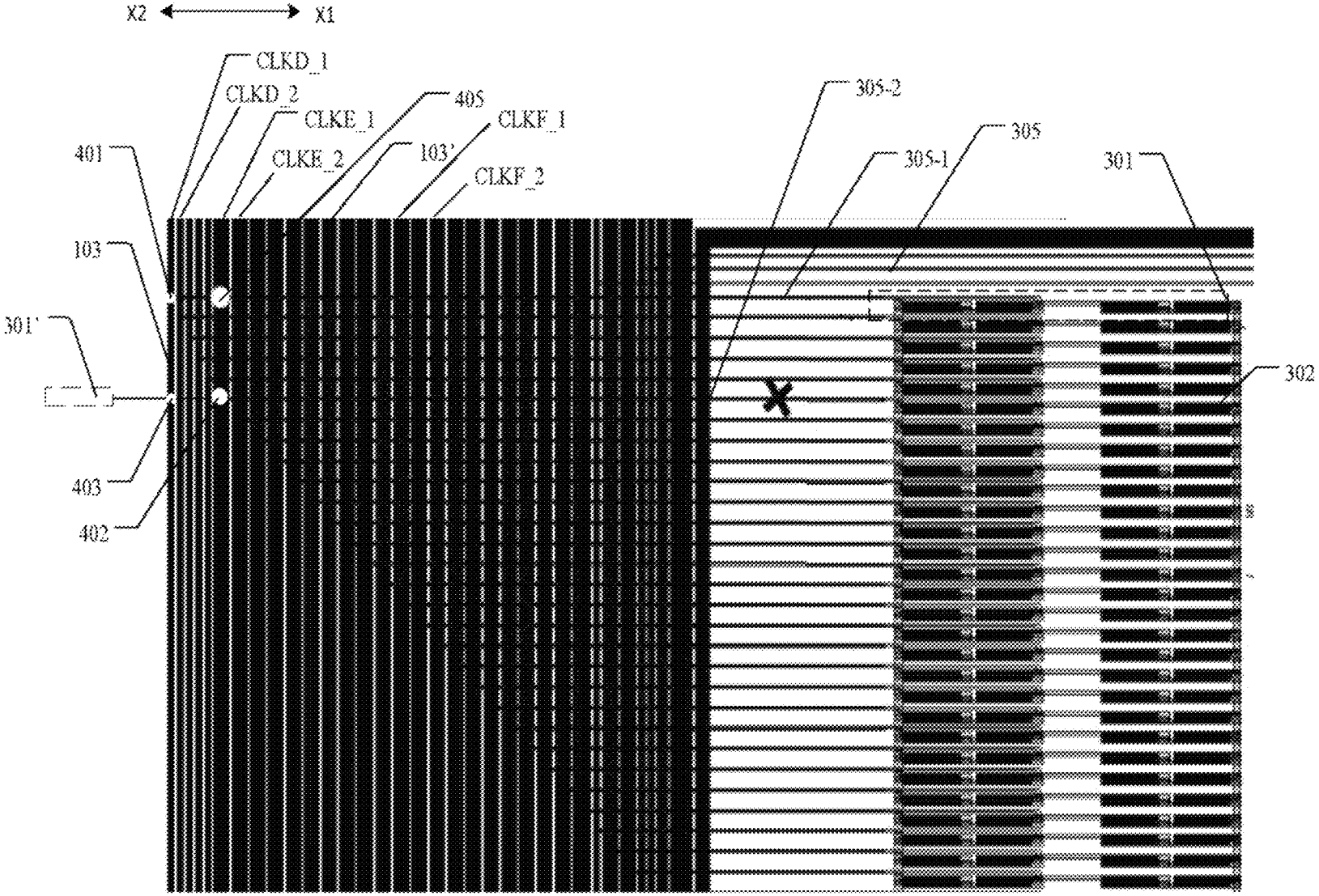
FIG. 9 shows an exemplary wiring schematic diagram of the gate drive circuit of FIG. 8 after repair.

In addition, as shown in FIG. 9, each first clock signal line is provided with a first connecting line 305-1 in a one-to-one correspondence, and each second clock signal line is provided with a second connecting line 305-2 in a one-to-one correspondence. Each first clock signal line or each second clock signal line is connected to an electrostatic protection sub-circuit 301 through a corresponding connecting line. These electrostatic protection sub-circuits can effectively prevent the first clock signal lines or the second clock signal lines from electrostatic damage. The connecting lines include first connecting lines 305-1 and second connecting lines 305-2.

In an exemplary embodiment, a first connecting line for the first clock signal line to be repaired is connected to a second clock signal line corresponding to the first clock signal line to be repaired; or a second connecting line for a second clock signal line is connected to the clock signal line to be repaired corresponding to the second clock signal line.

Taking FIG. 9 as an example, when any clock signal line is broken, the clock signal line to be repaired is connected to a corresponding second clock signal line through a connecting line. In FIG. 9, when the first clock signal line CKLE_1 is broken, the first clock signal line is connected to the second clock signal line CKLD_1 corresponding to the first clock signal line so as to repair the first clock signal line. Or, when a second clock signal line is broken, the second clock signal line to be repaired is electrically connected to the corresponding first clock signal line through a second connecting line to repair the second clock signal line.

There may be multiple second clock signal lines. For example, there are five clock signal lines in FIG. 9. For the sake of brevity, only the second clock signal lines CKLD_1 and CKLD_2 are given reference numerals, and only the clock signal lines CKLE_1, CKLE_2, CKLF_1, and CKLF_2 are given reference signs.

When the first clock signal line CKLE_1 is broken and needs to be repaired, one first clock signal line CKLE_1 can be short-connected to the second clock signal line CLKD_1. If there are two first clock signal lines that are broken and need to be repaired, for example, the first clock signal CKLE_1 and the first clock signal line CKLE_2 need to be repaired, the first clock signals CKLE_1 and the first clock signal line CKLE_2 are both short-connected with the second clock signal line CLKD_1.

As shown in FIG. 9, the first clock signal line CKLE_1 leads out at the connecting point 401 and is connected to a corresponding electrostatic protection circuit via the first connecting line 305-1, and the second clock signal line CKLD_1 leads out at the connecting point 402 and is connected to a corresponding electrostatic protection circuit via the second connecting line 305-2. In this case, the first connecting line 305-1 and the second clock signal line CKLD_1 are connected through the intersection point 405 of the first connecting line 305-1 and the second clock signal line CKLD_1. In this way, the first connecting line 305-1 is connected to the first clock signal line CKLE_1 through the connecting point 401, and is connected to the second clock signal line CKLD_1 through the intersection point 405, thereby realizing the connection between the first clock signal line CKLE_1 and the second clock signal line CKLD_1. In the same way, when the electrostatic protection sub-circuit 301' is located in the X2 direction of the clock signal lines, the connection between the first clock signal line CKLE_1 and the second clock signal line CKLD_1 can be realized through the intersection point 403 of the second connecting line 305-2 and the first clock signal line CKLE_1.

In an exemplary embodiment, only one of the first connecting line for the first clock signal line to be repaired and a second connecting line for a second clock signal line corresponding to the first clock signal line to be repaired is set to be connected to a corresponding electrostatic protection sub-circuit, and the other connecting line is set to be disconnected from a corresponding electrostatic protection sub-circuit. For example, the first connecting line connected to the first clock signal line to be repaired is set to be connected to a corresponding electrostatic protection sub-circuit, and the second connecting line connected to the second clock signal line corresponding to the first clock signal line to be repaired is set to be disconnected from a corresponding electrostatic protection sub-circuit.

In an exemplary embodiment, only one of a second connecting line connected to a second clock signal line to be repaired and a first connecting line connected to a first clock signal line corresponding to the second clock signal line to be repaired is set to be connected to a corresponding electrostatic protection sub-circuit, and the other connecting line is set to be disconnected from a corresponding electrostatic protection sub-circuit. For example, the second connecting line connected to the second clock signal line to be repaired is set to be connected to a corresponding electrostatic protection sub-circuit, and the first connecting line connected to the first clock signal line corresponding to the second clock signal line to be repaired is set to disconnect from a corresponding electrostatic protection sub-circuit.

After the first clock signal line to be repaired is connected to the corresponding second clock signal line through the connecting line, the electrostatic protection sub-circuit for the clock signal line and the electrostatic protection sub-circuit for the corresponding second clock signal line are short-connected. In order to avoid the short connection of the electrostatic protection sub-circuits, only one of the electrostatic protection sub-circuits is connected to the repaired first clock signal line.

Specifically, as shown in FIG. 9, after the connection between the first clock signal line CKLE_1 and the second clock signal line CKLD_1, by disconnecting the second connecting line 305-2, the connection between the second clock signal line CKLD_1 and the corresponding electrostatic protection sub-circuit is broken, and the connection between the first connecting line 305-1 for the clock signal line CKLE_1 and the corresponding electrostatic protection sub-circuit is maintained. In this way, the short connection between the electrostatic protection sub-circuit for the first clock signal line CKLE_1 before repair and the electrostatic protection sub-circuit for the second clock signal line CKLD_1 can be avoided, and the electrostatic protection of the repaired first clock signal line CKLE_1 can be ensured.

Figure 10:
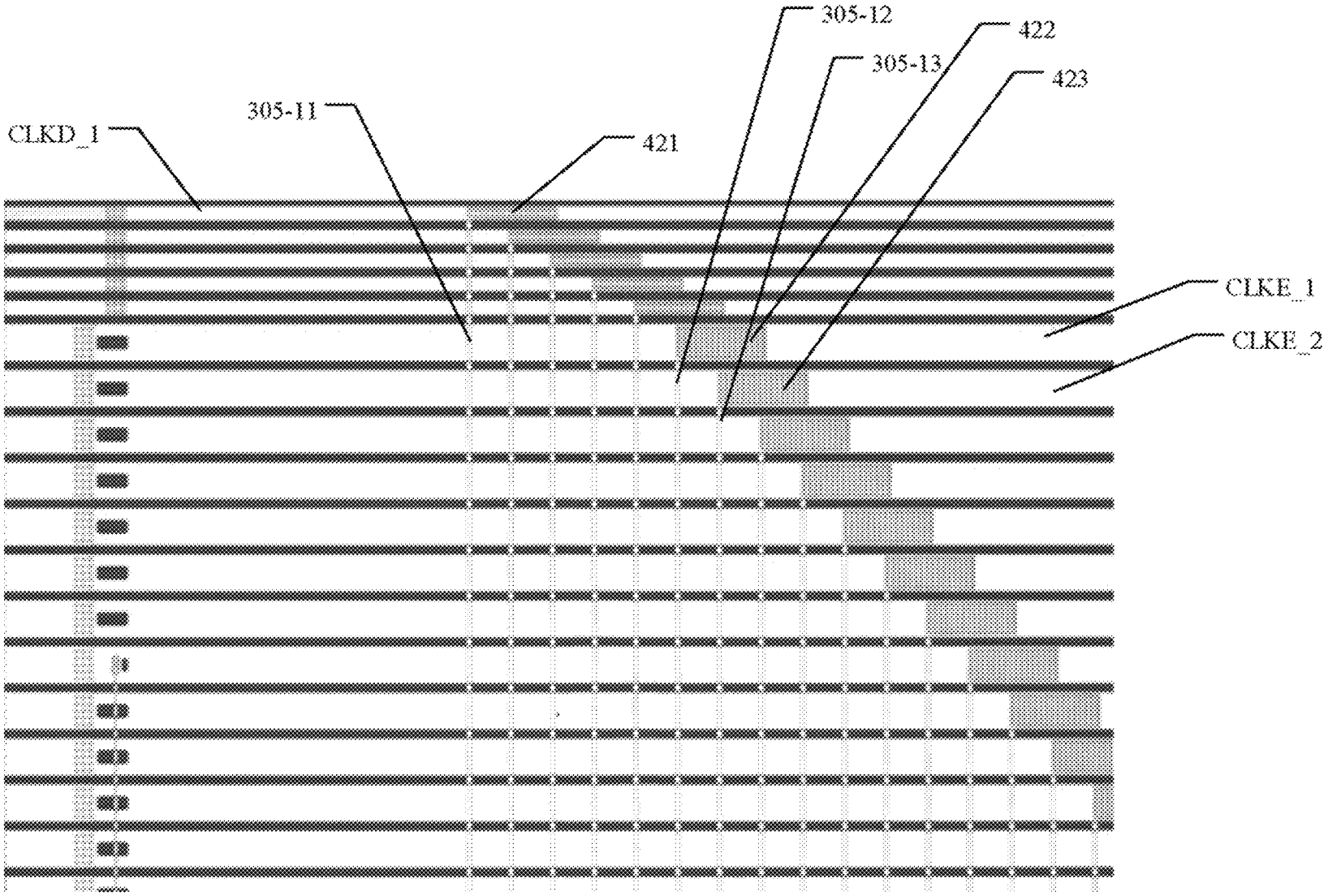
FIG. 10 shows an exemplary wiring diagram of a gate drive circuit according to another embodiment of the present disclosure.

FIG. 10 shows an example in which multiple clock signal lines are provided with second clock signal lines. As shown in FIG. 10, for subsequent repair, the first clock signal line CLKE_1 and the first clock signal line CLKE_2 are provided with a second clock signal line CLKD_1, that is, the clock signal line CLKE_1 and the clock signal line CLKE_2 share a repair line. Moreover, in this embodiment, the first clock signal line CLKE_1 and the first clock signal line CLKE_2 can be shared. The second clock signal line CLKD_1 is connected to the second connecting line 305-11 through the connecting point 421, the first clock signal line CLKE_1 is connected to the first connecting line 305-12 through the connecting point 422, and the first clock signal line CLKE_2 is connected to the first connecting line 305-13 through the connecting point 423.

Figure 11:
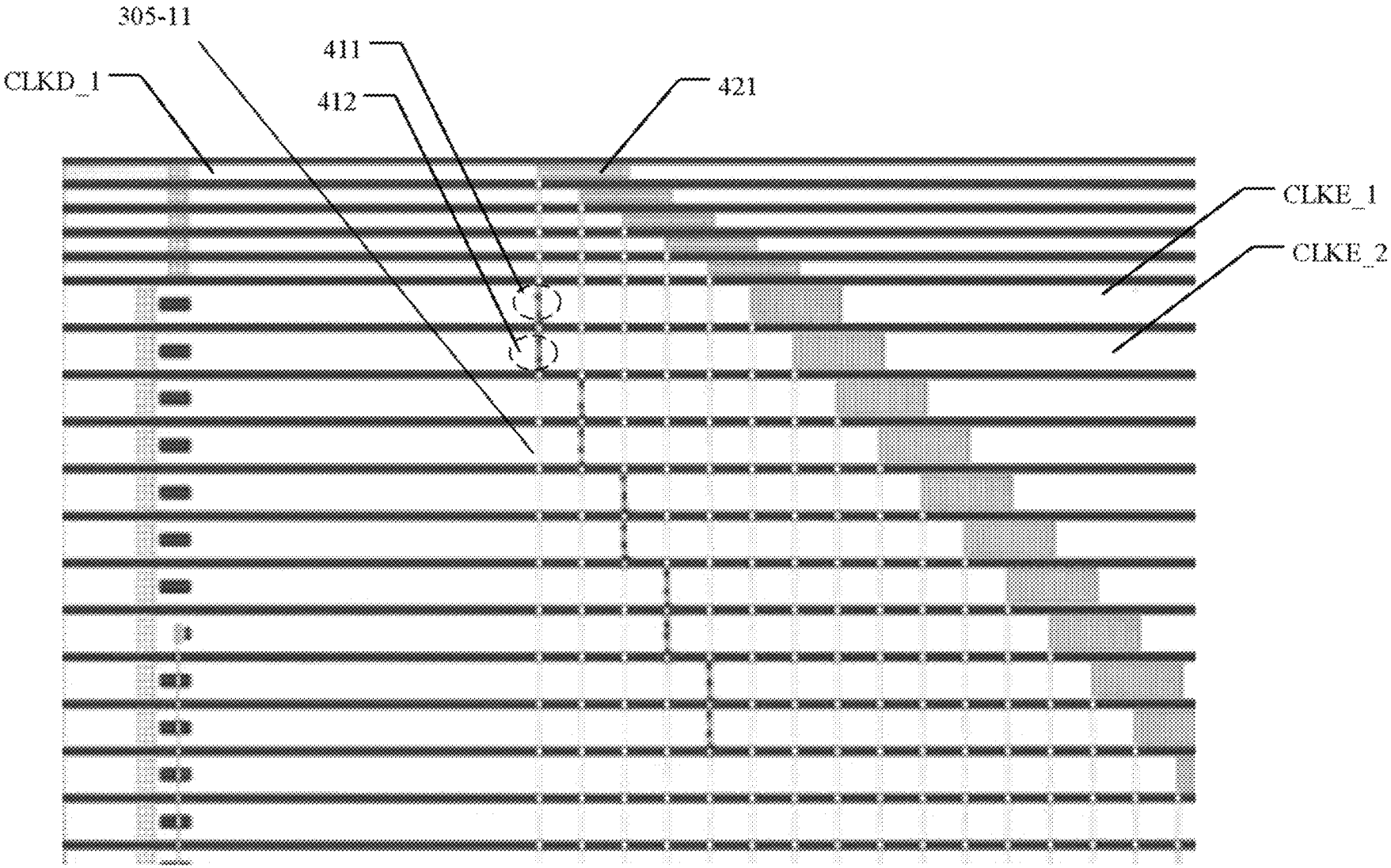
FIG. 11 shows an exemplary wiring diagram of the gate drive circuit of FIG. 10 after repair.

In this case, when any one of the first clock signal line CLKE_1 and the first clock signal line CLKE_2 is broken, or when the first clock signal line CLKE_1 and the first clock signal line CLKE_2 are both broken, the second connecting line 305-11 is connected with the first clock signal line CLKE_1 and the first clock signal line CLKE_2 to realize the connection among the second clock signal line CLKD_1, the first clock signal line CLKE_1, and the first clock signal line CLKE_2. Specifically, as shown in FIG. 11, the second connecting line 305-11 is connected to the first clock signal line CLKE_1 and the clock signal line CLKE1 through the intersection point 411 and the intersection point 412 on the second connecting line 305-11. The first connecting line 305-12 and the first connecting line 305-13 are disconnected from corresponding electrostatic protection sub-circuits (not shown in the figure), and only the connection between the second connecting line 305-11 and its corresponding electrostatic protection sub-circuit is maintained, so as to prevent short connection between the electrostatic protection sub-circuits.

The present disclosure also provides a display device. The display device includes a gate drive circuit provided by various embodiments of the present disclosure, a clock signal generator 106, and a clock signal interface 105. The clock signal interface 105 is provided on the circuit board where the gate drive circuit is located.

The display device includes a display panel, a tablet computer, a mobile phone, a television, an electronic frame, a desktop computer, etc.

The clock signal generator 106 is used to provide corresponding clock signals to the first clock signal lines 103 and the second clock signal lines 103' of the gate drive circuit 102.

The clock signal interface 105 is used to input the clock signals of the clock signal generator to the gate drive circuit.

The present disclosure also provides a repair method for the display device provided by the various embodiments of the present disclosure. The repair method includes the following steps:

determining a clock signal line to be repaired which is broken, the breakage occurring on a line segment from a clock signal interface of the first clock signal line to a corresponding electrostatic protection sub-circuit;

connecting the first clock signal line to be repaired with a second clock signal line through a connecting line;

keeping only one of the first connecting line for the clock signal line to be repaired and the second connecting line for the second clock signal line corresponding to the first clock signal line to be repaired being connected to a corresponding electrostatic protection sub-circuit, while disconnecting the other connecting line from a corresponding electrostatic protection sub-circuit.

As shown in FIG. 9, when the first clock signal line CKLE_1 is broken, the intersection point 405 between the second clock signal line CKLD_1 and the first connecting line 305-1 is found, and at the intersection point 405, the first connecting line 305-1 is connected with the second clock signal line CKLD_1. The first connecting line 305-1 is a connecting line between the clock signal line CKLE_1 and a corresponding electrostatic protection sub-circuit. Therefore, by connecting the first connecting line 305-1 and the second clock signal line CKLD_1, the connection between the first clock signal line CKLE_1 and the second clock signal line CKLD_1 is realized. It should be noted that the above example shows that the static electricity protection sub-circuit 301 is arranged in the X1 direction of the clock signal lines, the electrostatic protection sub-circuits 301' can also be arranged in the X2 direction of the clock signal lines. In this case, the intersection point 403 required for repair is located at the intersection of the clock signal line CKLE_1 and the connecting line 305-2. The connecting line 305-2 is a connecting line between the second clock signal line CKLD_1 and a corresponding electrostatic protection sub-circuit. When performing connection at the intersection point, a hole is punched at the intersection point, so that a through hole is formed between the circuit board layer where the connecting line is located and the circuit board layer where the second clock signal line is located, and the through hole is filled with tungsten powder to realize the connection between the connecting line and the second clock signal line. Accordingly, the connection between the second clock signal line CKLD_1 and the first clock signal line CKLE_1 is realized.

Or, when the second connecting line is connected to the first clock signal line to be repaired based on the intersection point, a hole is punched at the intersection point, so that a through hole is formed between the circuit board layer where the second connecting line is located and the circuit board layer where the first clock signal line to be repaired is located, and the through hole is filled with tungsten powder to realize the connection between the connecting line and the clock signal line to be repaired. Accordingly, the connection of the first clock signal line CKLE_1 and the second clock signal line CKLD_1 is also realized.

In addition, as shown in FIG. 9, after the connection between the first clock signal line CKLE_1 and the second clock signal line CKLD_1, by disconnecting the second connecting line 305-2, the second clock signal line CKLD_1 and its corresponding electrostatic protection sub-circuit are disconnected, and the connection between the first connecting line 305-1 for the first clock signal line CKLE_1 and the corresponding electrostatic protection sub-circuit is maintained. In this way, the short connection between the electrostatic protection sub-circuit for the first clock signal line CKL1 before repair and the electrostatic protection sub-circuit for the second clock signal line CKLD_1 can be avoided, and the electrostatic protection for the repaired first clock signal line CKL1 can be ensured. It should be noted that the disconnecting of the connecting line can also be performed before connecting the first clock signal line CKLE_1 and the second clock signal line CKLD_1.

The above describes exemplary embodiments and technical principles in the present disclosure. Those skilled in the art should understand that the scope of the present disclosure is not limited to the technical solutions formed by the specific combination of the above technical features, and the scope of the present disclosure should also cover other technical solutions formed by any combination of the above features or equivalent features without departing from the inventive concepts described herein. For example, the above features and technical features disclosed in the present disclosure (but not limited to) having similar functions may be replaced with each other to form a technical solution, and such technical solution also falls within the scope of the present disclosure.

What is claimed is:

1. A gate drive circuit which adopts a multilayer circuit board structure and comprises: a plurality of cascaded GOA units, a plurality of first clock signal lines, a plurality of second clock signal lines, connecting lines and a plurality of electrostatic protection sub-circuits;

wherein:

the plurality of first clock signal lines are electrically connected to the GOA units, and configured to provide various clock signals to the GOA units;

the plurality of second clock signal lines are electrically connected to the GOA units, and are configured to, when any of the clock signal lines is broken, replace the broken clock signal line to transmit a corresponding clock signal;

the plurality of electrostatic protection sub-circuits are electrically connected to corresponding first clock signal lines or corresponding second clock signal lines through the connecting lines, so as to prevent the first clock signal lines or the second clock signal lines from being damaged by static electricity; and the connecting lines are arranged on a layer in the multilayer circuit board structure which is different from layers where the first clock signal lines and the second clock signal lines are arranged in the multilayer circuit board structure, and orthographic projections of the connecting lines on a plane where corresponding first clock signal lines or corresponding second clock signal lines are located intersect with the corresponding first clock signal lines and the corresponding second clock signal lines, respectively;

wherein:

the connecting lines comprise a plurality of first connecting lines and a plurality of second connecting lines, and each of the first clock signal lines is connected to one of the first connecting lines; and each of the second clock signal lines is connected to one of the second connecting lines.

2. The gate drive circuit according to claim 1, wherein the plurality of first clock signal lines and the plurality of second clock signal lines are arranged on a same layer in the circuit board and arranged side by side.

3. The gate drive circuit according to claim 2, wherein the plurality of first clock signal lines are located on sides of the plurality of second clock signal lines away from the GOA units.

4. The gate drive circuit according to claim 1, wherein the second clock signal lines and the first clock signal lines are arranged in a one-to-one correspondence.

5. The gate drive circuit according to claim 1, wherein:

the plurality of first clock signal lines comprise a first clock signal line to be repaired, and the first clock signal line to be repaired is electrically connected to a second clock signal line corresponding to the first clock signal line to be repaired through one of the first connecting lines; or the plurality of second clock signal lines comprise a second clock signal line to be repaired, and the second clock signal line to be repaired is electrically connected to a first clock signal line corresponding to the second clock signal line to be repaired through one of the second connecting lines.

6. The gate drive circuit according to claim 5, wherein:

only one of the first connecting line connected to the first clock signal line to be repaired and a second connecting line connected to the second clock signal line corresponding to the first clock signal line to be repaired is set to be electrically connected to a corresponding electrostatic protection sub-circuit, and the other connecting line is set to be disconnected from corresponding electrostatic protection sub-circuits; or, only one of the second connecting line connected to the second clock signal line to be repaired and a first connecting line connected to the first clock signal line corresponding to the second clock signal line to be repaired is set to be electrically connected to a corresponding electrostatic protection sub-circuit, and the other connecting line is set to be disconnected from corresponding electrostatic protection sub-circuits.

7. The gate drive circuit according to claim 6, wherein:

the first connecting line connected to the first clock signal line to be repaired is set to be connected to the corresponding electrostatic protection sub-circuit, and the second connecting line connected to the second clock signal line corresponding to the first clock signal line to be repaired is set to be disconnected from a corresponding electrostatic protection sub-circuit.

8. The gate drive circuit according to claim 6, wherein:

the second connecting line connected to the second clock signal line to be repaired is set to be connected to the corresponding electrostatic protection sub-circuit, and the first connecting line connected to the first clock signal line corresponding to the second clock signal line to be repaired is set to be disconnected from a corresponding electrostatic protection sub-circuit.

9. The gate drive circuit according to claim 1, wherein a number of the plurality of second clock signal lines is twice that of the plurality of first clock signal lines, and one of the first clock signal lines corresponds to two of the second clock signal lines.

10. The gate drive circuit according to claim 9, wherein:

the plurality of first clock signal lines comprise a first clock signal line to be repaired, and the first clock signal line to be repaired is electrically connected to two second clock signal lines corresponding to the first clock signal line to be repaired through the first connecting lines.

11. A display device comprising a gate drive circuit, and further comprising a clock signal generator and a clock signal interface, wherein the gate drive circuit which adopts a multilayer circuit board structure and comprises: a plurality of cascaded GOA units, a plurality of first clock signal lines, a plurality of second clock signal lines, connecting lines and a plurality of electrostatic protection sub-circuits;

wherein:

the plurality of first clock signal lines are electrically connected to the GOA units, and configured to provide various clock signals to the GOA units;

the plurality of second clock signal lines are electrically connected to the GOA units, and are configured to, when any of the clock signal lines is broken, replace the broken clock signal line to transmit a corresponding clock signal;

the plurality of electrostatic protection sub-circuits are electrically connected to corresponding first clock signal lines or corresponding second clock signal lines through the connecting lines, so as to prevent the first clock signal lines or the second clock signal lines from being damaged by static electricity; and the connecting lines are arranged on a layer in the multilayer circuit board structure which is different from layers where the first clock signal lines and the second clock signal lines are arranged in the multilayer circuit board structure, and orthographic projections of the connecting lines on a plane where corresponding first clock signal lines or corresponding second clock signal lines are located intersect with the corresponding first clock signal lines and the corresponding second clock signal lines, respectively;

wherein the clock signal interface is connected with the clock signal generator, and the clock signal interface is provided on a circuit board where the gate drive circuit is located;

wherein the clock signal generator is configured to provide corresponding clock signals to the first clock signal line and the second clock signal line in the gate drive circuit; and wherein the clock signal interface is configured to input the clock signals from the clock signal generator to the gate drive circuit;

wherein:

the connecting lines comprise a plurality of first connecting lines and a plurality of second connecting lines, and each of the first clock signal lines is connected to one of the first connecting lines; and each of the second clock signal lines is connected to one of the second connecting lines.

12. A repair method for a gate drive circuit;

wherein the gate drive circuit adopts a multilayer circuit board structure and comprises: a plurality of cascaded GOA units, a plurality of first clock signal lines, a plurality of second clock signal lines, connecting lines and a plurality of electrostatic protection sub-circuits;

wherein:

the plurality of first clock signal lines are electrically connected to the GOA units, and configured to provide various clock signals to the GOA units;

the plurality of second clock signal lines are electrically connected to the GOA units, and are configured to, when any of the clock signal lines is broken, replace the broken clock signal line to transmit a corresponding clock signal;

the plurality of electrostatic protection sub-circuits are electrically connected to corresponding first clock signal lines or corresponding second clock signal lines through the connecting lines, so as to prevent the first clock signal lines or the second clock signal lines from being damaged by static electricity; and the connecting lines are arranged on a layer in the multilayer circuit board structure which is different from layers where the first clock signal lines and the second clock signal lines are arranged in the multilayer circuit board structure, and orthographic projections of the connecting lines on a plane where corresponding first clock signal lines or corresponding second clock signal lines are located intersect with the corresponding first clock signal lines and the corresponding second clock signal lines, respectively;

wherein the repair method comprises:

determining a first clock signal line to be repaired which is broken;

connecting the first clock signal line to be repaired to one of second clock signal lines through connecting lines, wherein the connecting lines comprise a first connecting line connected to the first clock signal line to be repaired and a second connecting line connected to the one of second clock signal lines; and/or determining a second clock signal line to be repaired, wherein the second clock signal line to be repaired is electrically connected to one of first clock signal lines corresponding to the second clock signal line to be repaired through the second connecting line;

keeping only one of the following connecting lines being connected to a corresponding electrostatic protection sub-circuit: the first connecting line connected to the first clock signal line to be repaired; and the second connecting line connected to the second clock signal line corresponding to the first clock signal line to be repaired, and disconnecting the other connecting line from a corresponding electrostatic protection sub-circuit;

or keeping only one of the following connecting lines being connected to a corresponding electrostatic protection sub-circuit: the second connecting line connected to the second clock signal line to be repaired; and the first connecting line connected to the first clock signal line corresponding to the second clock signal line to be repaired, and disconnecting the other connecting line from a corresponding electrostatic protection sub-circuit.

13. The repair method according to claim 12, wherein connecting the first clock signal line to be repaired to one of second clock signal lines through connecting lines, comprises:

obtaining an intersection point between an orthographic projection of the first connecting line connected to the first clock signal line to be repaired on a plane wherein the second clock signal line corresponding to the first clock signal line to be repaired is located and the second clock signal line, and connecting the first connecting line and the second clock signal line based on the intersection point; or obtaining an intersection point between an orthographic projection of the second connecting line connected to the second clock signal line on a plane wherein the first clock signal line to be repaired corresponding to the second clock signal line is located and the first clock signal line to repaired, and connecting the second connecting line and the first clock signal line to be repaired based on the interaction point.

14. The repair method according to claim 13, wherein connecting the first connecting line and the second clock signal line based on the intersection point comprises:

punching a through hole at the intersection point, to make the through hole formed between a circuit board layer where the first connecting line is located and a circuit board layer where the second clock signal line is located, and filing the through hole with tungsten powder to realize connection between the first connecting line and the second clock signal line; or wherein connecting the second connecting line and the first clock signal line to be repaired based on the intersection point comprises:

punching a through hole at the intersection point, to make the through hole formed between a circuit board layer where the second connecting line is located and a circuit board layer where the clock signal line to be repaired is located, and filing the through hole with tungsten powder to realize connection between the second connecting line and the first clock signal line to be repaired.

15. The display device according to claim 11, wherein the plurality of first clock signal lines and the plurality of second clock signal lines are arranged on a same layer in the circuit board and arranged side by side.

16. The display device according to claim 15, wherein the plurality of first clock signal lines are located on sides of the plurality of second clock signal lines away from the GOA units.

17. The display device according to claim 11, wherein the second clock signal lines and the first clock signal lines are arranged in a one-to-one correspondence.

18. The display device according to claim 11, wherein:

the plurality of first clock signal lines comprise a first clock signal line to be repaired, and the first clock signal line to be repaired is electrically connected to a second clock signal line corresponding to the first clock signal line to be repaired through one of the first connecting lines; or the plurality of second clock signal lines comprise a second clock signal line to be repaired, and the second clock signal line to be repaired is electrically connected to a first clock signal line corresponding to the second clock signal line to be repaired through one of the second connecting lines.

* * * * *